US010767293B1

(12) United States Patent
Tseng

(10) Patent No.: US 10,767,293 B1
(45) Date of Patent: Sep. 8, 2020

(54) SEWING-THREAD PRE-STRESS DEVICE FOR A SEWING MACHINE

(71) Applicant: Hsien-Chang Tseng, Taichung (TW)

(72) Inventor: Hsien-Chang Tseng, Taichung (TW)

( * ) Notice: Subject to any disclaimer, the term of this patent is extended or adjusted under 35 U.S.C. 154(b) by 0 days.

(21) Appl. No.: 16/590,041

(22) Filed: Oct. 1, 2019

(51) Int. Cl.
*D05B 47/02* (2006.01)
*D05B 47/00* (2006.01)

(52) U.S. Cl.
CPC ..... *D05B 47/02* (2013.01); *D05B 47/00* (2013.01)

(58) Field of Classification Search
CPC ..... D05B 47/00; D05B 47/02; D05B 47/04; D05B 47/06; D05B 59/10; D05B 59/14
USPC ..... 112/254, 255
See application file for complete search history.

(56) References Cited

U.S. PATENT DOCUMENTS 4,161,152 A * 7/1979 Herron ..... D05B 51/00 112/254
4,180,006 A * 12/1979 Ross ..... D05B 47/00 112/254
4,372,502 A * 2/1983 Larsen ..... D05B 47/00 112/254
5,603,462 A * 2/1997 Conrad ..... B65H 69/00 112/254
6,932,009 B1 * 8/2005 Chen ..... D05B 47/02 112/254
6,957,616 B1 * 10/2005 Chang ..... D05B 47/02 112/254
7,240,628 B2 * 7/2007 Friman ..... D05B 47/04 112/475.01
8,468,962 B2 * 6/2013 Tseng ..... D05B 87/00 112/255
2009/0165687 A1 * 7/2009 Takeshita ..... D05B 47/00 112/254
2014/0209002 A1 * 7/2014 Takagi ..... D05B 63/00 112/298
2015/0075414 A1 * 3/2015 Tseng ..... D05B 47/00 112/254

* cited by examiner

*Primary Examiner* — Danny Worrell
(74) *Attorney, Agent, or Firm* — Wang Law Firm, Inc.

(57) ABSTRACT

A sewing-thread pre-stress device for a sewing machine includes: a sewing-thread support, a pre-stress supply member, an abutting member and a top cover. The sewing-thread support includes an accommodating groove with a groove bottom. The pre-stress supply member is made of elastic material, provided in the accommodating groove, and has a folding portion which has two extension portions with one end connected to two sides of the folding portion. The abutting member is disposed on the pre-stress supply member, and the two abutting portions abut against the abutting member. The top cover is disposed on the abutting member and fixed to the sewing-thread support to define a thread space between the top cover and the abutting member for allowing a sewing thread to be inserted therethrough. The member is elastic and V-shaped, therefore the elastic force change is relatively small, which can provide the sewing thread an appropriate tension.

14 Claims, 12 Drawing Sheets

SEWING-THREAD PRE-STRESS DEVICE FOR A SEWING MACHINE

BACKGROUND

Field of the Invention

The present invention relates to a related component of a sewing machine, and more particularly to a sewing-thread pre-stress device for a sewing machine.

Related Prior Art

A sewing machine is usually equipped with a sewing-thread-prestress supply device which provides a suitable pre-stress for the sewing thread so that the sewing thread can maintain proper tension for subsequent sewing operations. The sewing-thread pre-stress device of the sewing machine is shown in FIG. 11 and comprises: a base 70, a sponge 81, an abutting member 82 and a top cover 83.

The base 70 has at least one groove 71.

The sponge 81 is disposed in the groove 71.

The abutting member 82 is disposed on the sponge 81, so that the sponge 81 is pressed against one surface of the abutting member 82.

The top cover 83 is disposed on the abutting member 82, and a thread space 84 is formed between the top cover 83 and the abutting member 82 for allowing a sewing thread 90 to be inserted therethrough. One surface of the top cover 83 facing the abutting member 82 is provided with two protruding portions 831 which press against another surface of the abutting member 82 opposite to the surface of the abutting member 82 facing the sponge 81.

Thereby, when the sewing thread 90 is inserted in the thread space 84, the sponge 81 provides an upward force pushing the abutting member 82 to move toward the top cover 83, thereby clamping tight the sewing thread 90 inserted in the thread space 84 to provide the sewing thread 90 a proper tension.

However, the aforementioned sponge 81 is prone to fatigue and deterioration after being used for a period of time, resulting in failure to provide an appropriate pressing force and further resulting in failing to provide a proper tension.

In addition, the protruding portions 831 of the top cover 83 are likely to interfering with the extending of the sewing thread 90, and there is also a risk of pressing the sewing thread 90.

Furthermore, if the size of the protruding portions 831 of the top cover 83 is too large, the width of the thread space 84 may be too wide, which may result in failure to provide the sewing thread 90 with proper tension. On the other hand, if the size of the protruding portions 831 of the top cover 83 is too small, there is a possibility that the protruding portions 831 recover due to the restoring force of the metal, thereby failing to produce a corresponding effect.

In order to overcome the above many defects, a sewing thread pre-stress device for a sewing machine is required.

The present invention has arisen to mitigate and/or obviate the afore-described disadvantages.

SUMMARY

One objective of the present invention is to provide a sewing-thread pre-stress device for a sewing machine which is capable of providing the sewing thread an appropriate tension.

Another objective of the present invention is to extend the life of the product to avoid fatigue of the sewing-thread supply device.

To achieve the above objectives, a sewing-thread pre-stress device for a sewing machine in accordance with the present invention comprises:

a sewing-thread support including at least one accommodating groove which has a groove bottom;

a pre-stress supply member made of an elastic material, provided in the accommodating groove, and having a folding portion disposed at the groove bottom, and two extension portions each having one end connected to two sides of the folding portion;

an abutting member disposed on the pre-stress supply member, and the two abutting portions abut against the abutting member; and a top cover disposed on the abutting member and fixed to the sewing-thread support, so that a thread space is defined between the top cover and the abutting member for allowing a sewing thread to be inserted therethrough.

As can be seen from the foregoing, each embodiment of the sewing-thread pre-stress device for a sewing machine in accordance with the present invention mainly provides proper elasticity by the pre-stress supply member, since the pre-stress supply member is made of an elastic material and generally V-shaped, the amount of change in the elastic force is relatively small, the sewing thread of different diameters can be inserted into the thread space. When the thicker sewing thread is inserted into the thread space, it does not provide excessive abutting force, so that the sewing thread pressure is moderate, avoiding the problem that the knitted fabric wrinkles if the sewing thread pressure is excessively large or the sewing thread gets knotted if the sewing thread pressure is too small.

In addition, the pre-stress supply member is made of an elastic material, which can also effectively prevent the sewing-thread pre-stress supply device from elasticity fatigue.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION

Figure 1:
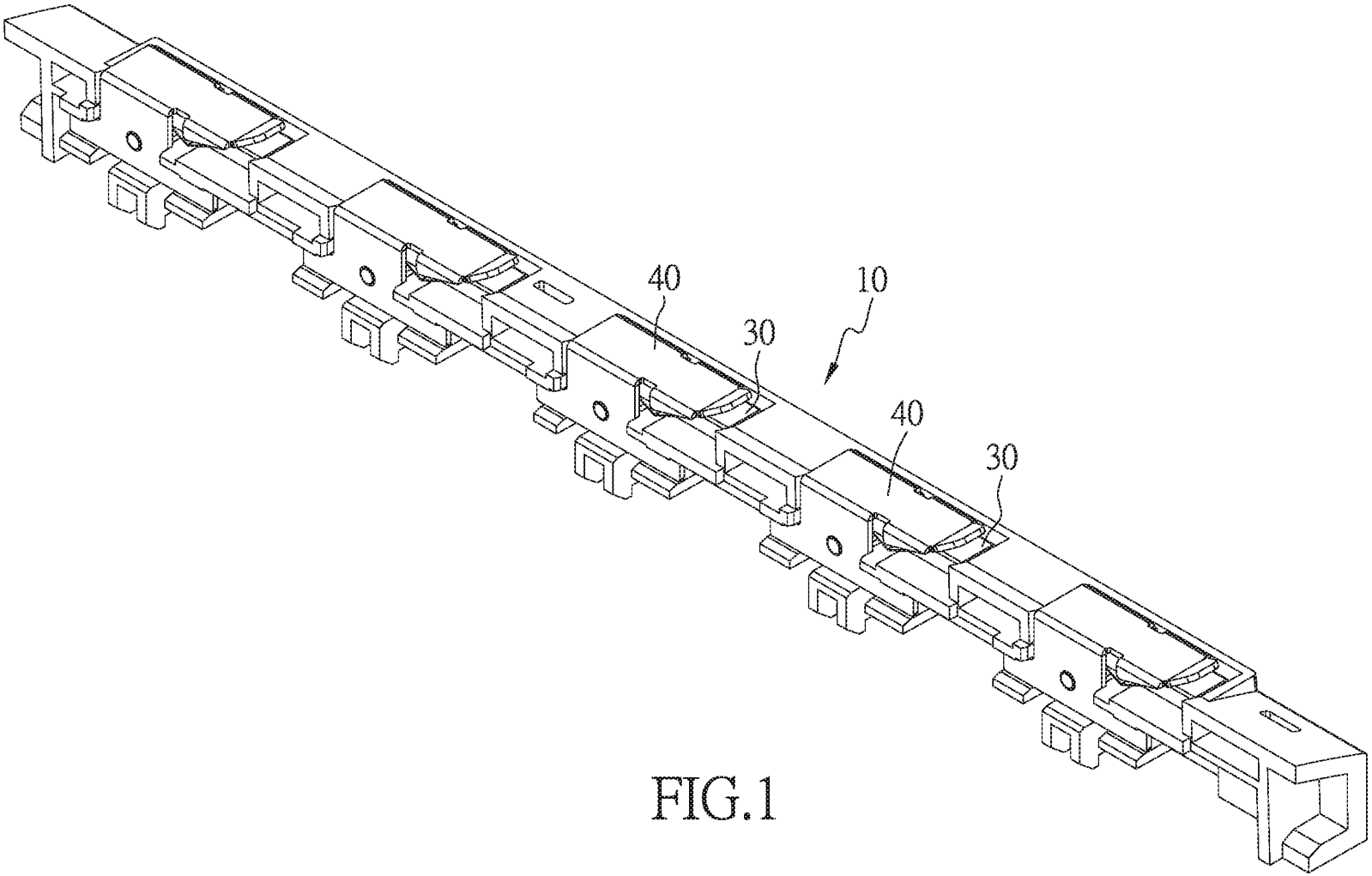
FIG. 1 is an assembly perspective view of the present invention.
Figure 2:
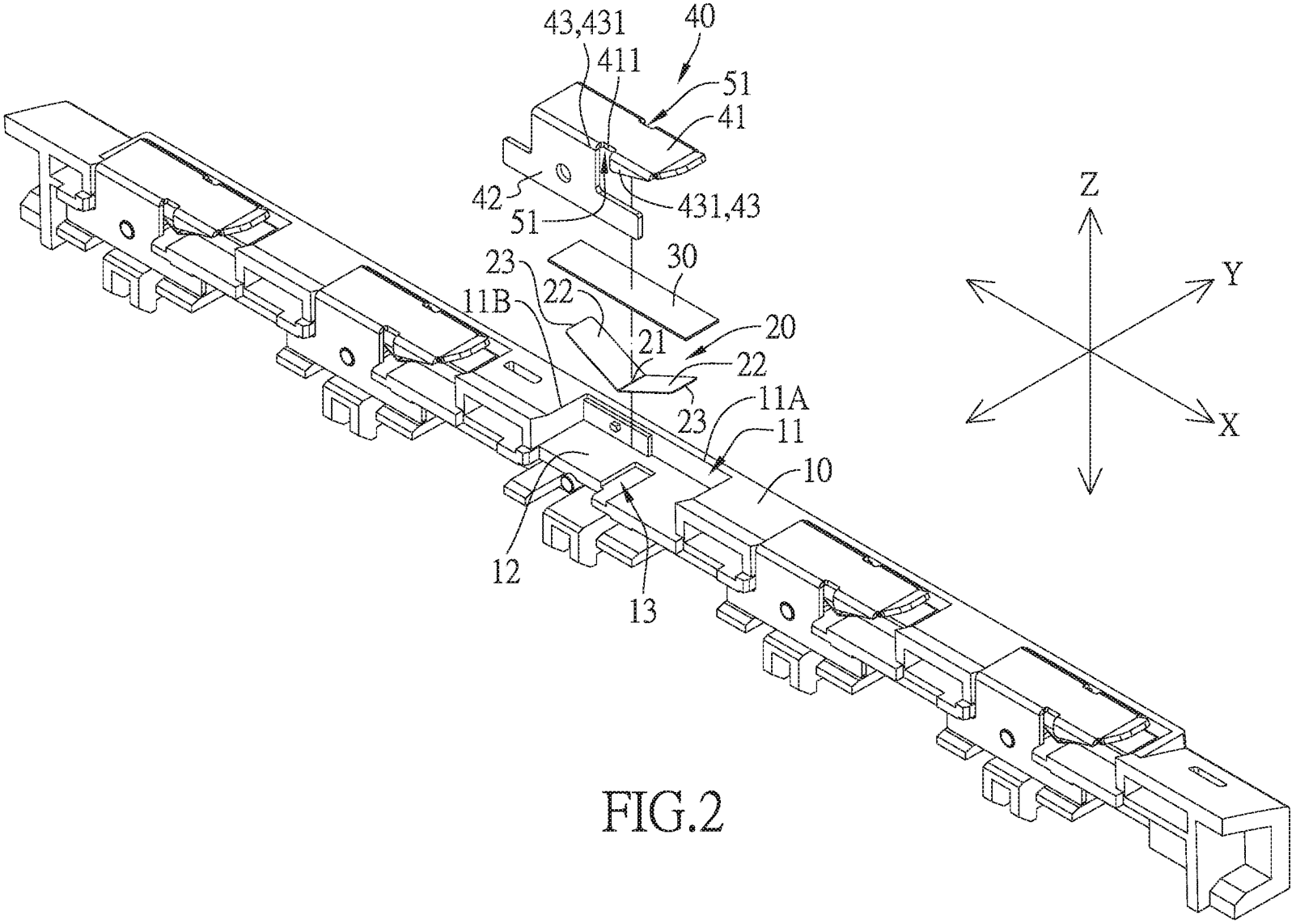
FIG. 2 is an exploded view of a first embodiment of the present invention.

The present invention will be clearer from the following description when viewed together with the accompanying drawings, which show, for purpose of illustrations only, the preferred embodiment in accordance with the present invention.

Referring to FIGS. 1-10, a sewing-thread pre-stress device for a sewing machine in accordance with the present invention comprises: a sewing-thread support 10, a pre-stress supply member 20, an abutting member 30, and a top cover 40.

The sewing-thread support 10 has at least one accommodating groove 11 which has a groove bottom 12. Preferably, the sewing-thread support 10 defines a plurality of accommodating grooves 11 along a longitudinal direction X. Each of the accommodating grooves 11 is a rectangular groove, and has a first side 11A along the longitudinal direction X. A direction perpendicular to the longitudinal direction X is defined as a transverse direction Y. Each of the accommodating grooves 11 has a second side 11B along the transverse direction Y.

In one embodiment, the sewing-thread support 10 is an independent structure and mounted at a predetermined position on the sewing machine.

In another embodiment, the sewing-thread support 10 is part of the sewing machine.

The pre-stress supply member 20, which is made of an elastic material, that is, a material that conforms to Hooke's law, is provided in the accommodating groove 11, and has a folding portion 21 disposed at the groove bottom 12, and two extension portions 22 each having one end connected to the two sides of the folding portion 21. An angle is formed between the two extension portions 22, so that the pre-stress supply member 20 is substantially V-shaped. Another end of each of the extension portions 22 opposite to the folding portion 21 has an abutting portion 23. Preferably, the abutting portion 23 extends in a direction perpendicular to the extending direction of the extension portions 22.

In a preferred embodiment, a limiting groove 13 is formed at the groove bottom 12 and located at a central position along the first side 11A of each of the accommodating grooves 11. The limiting groove 13 is an elongated groove and extends along the transverse direction Y, and the folding portion 21 is disposed in the limiting groove 13.

Preferably, the abutting portions 23 extend along the transverse direction Y.

Preferably, the extending direction of the extension portions 22 has a component of the longitudinal direction X.

Preferably, the angle is less than 180 degrees.

The abutting member 30 is disposed on the pre-stress supply member 20, and the two abutting portions 23 abut against the abutting member 30 to enable force to be transmitted between the abutting member 30 and the pre-stress supply member 20. The abutting member 30 can be a rectangular sheet member. In the preferred embodiment, the abutting member 30 has a first lateral portion 31, a top portion 32 and a second lateral portion 33 which are connected to one another. The top portion 32 has two opposite edges connected to the first and second lateral portions 31, 33 respectively. The first and second lateral portions 31, 33 are connected to the top portion 32 at an approximately right angle, so that the abutting member 30 is U-shaped at cross section, and the two abutting portions 23 are abutted against the top portion 32.

The top cover 40 is disposed on the abutting member 30, fixed to the sewing-thread support 10, and has a cover portion 41 and a locking portion 42. The locking portion 42 is fixed to the sewing-thread support 10 to prevent the top cover 40 from moving and tilting. The cover portion 41 is located on another surface of the abutting member 30 opposite to one surface thereof facing the pre-stress supply member 20. In other words, the cover portion 41 covers the abutting member 30 to define a thread space 50 between the top cover 40 and the abutting member 30, and the width of the thread space 50 can be controlled by the displacement of the abutting member 30. The thread space 50 allows the sewing thread L to be inserted therethrough, and the sewing thread L is inserted through the thread space 50 along the transverse direction Y.

In a preferred embodiment, the top cover 40 has a limiting portion 43 formed on each of two lateral surfaces 411 of the cover portion 41 adjacent to one end thereof. Each of the limiting portions 43 has two limiting bodies 431 extending along a height direction Z, respectively. A thread hole 51 is formed between the two limiting bodies 431 and communicates with the thread space 50, and the thread holes 51 are aligned to each other, so that the sewing thread L is restricted to insert in the thread space 50 only through the two thread holes 51 to limit the position of the sewing thread L in the longitudinal direction X, and as a result, the sewing thread L won't arbitrarily swing and interfere with the extension of the sewing thread 90, and the risk of pressing the sewing thread 90 can be effectively avoided.

Preferably, the sewing-thread support 10, the pre-stress supply member 20, the abutting member 30 and the top cover 40 are stacked along the height direction Z which is perpendicular to the transverse direction Y and the longitudinal direction X. Since the top cover 40 is fixed, moving the abutting member 30 along the height direction Z can control the width of the thread space 50.

Figure 3A:
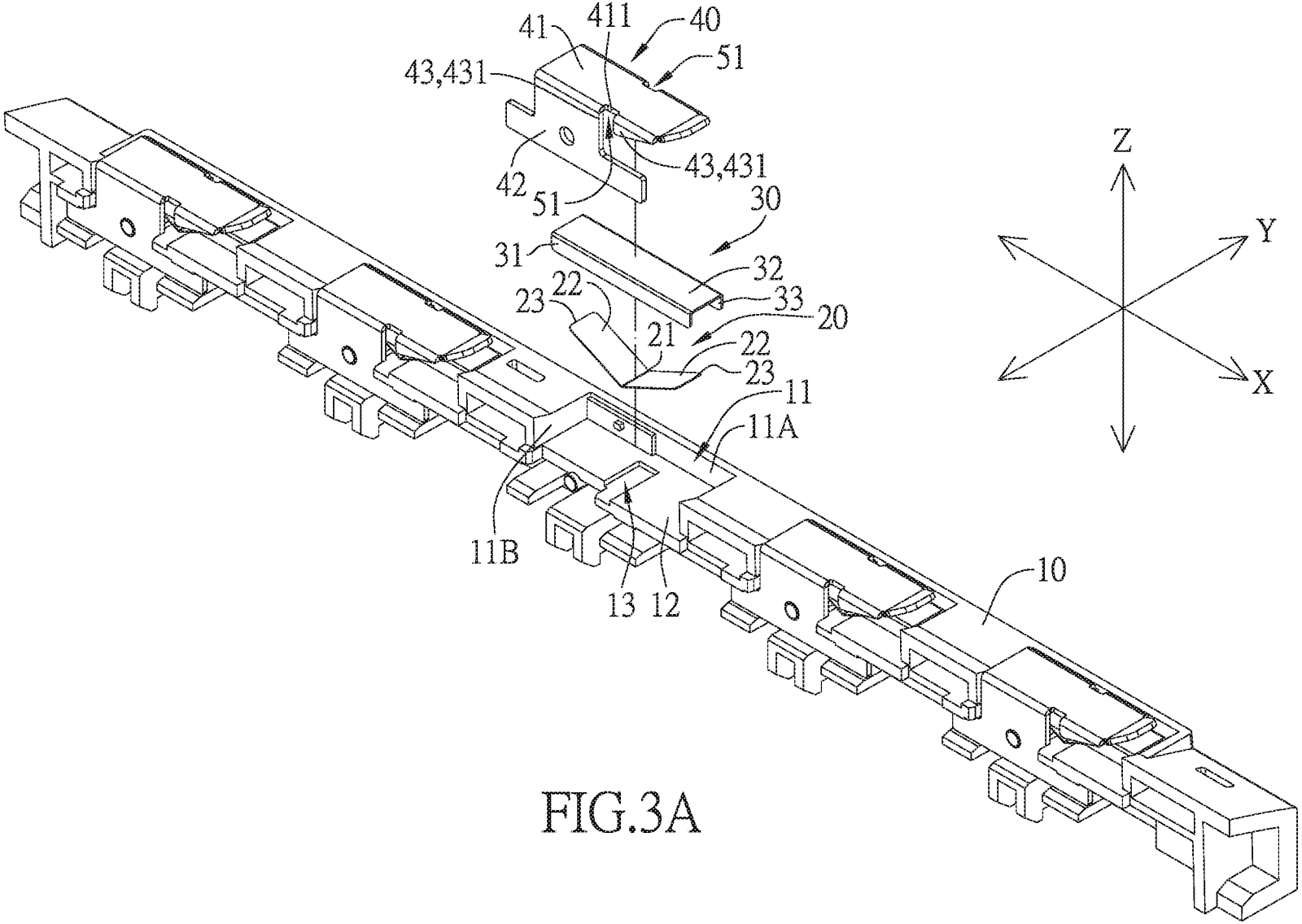
FIG. 3A is another exploded view of the first embodiment of the present invention.
Figure 3B:
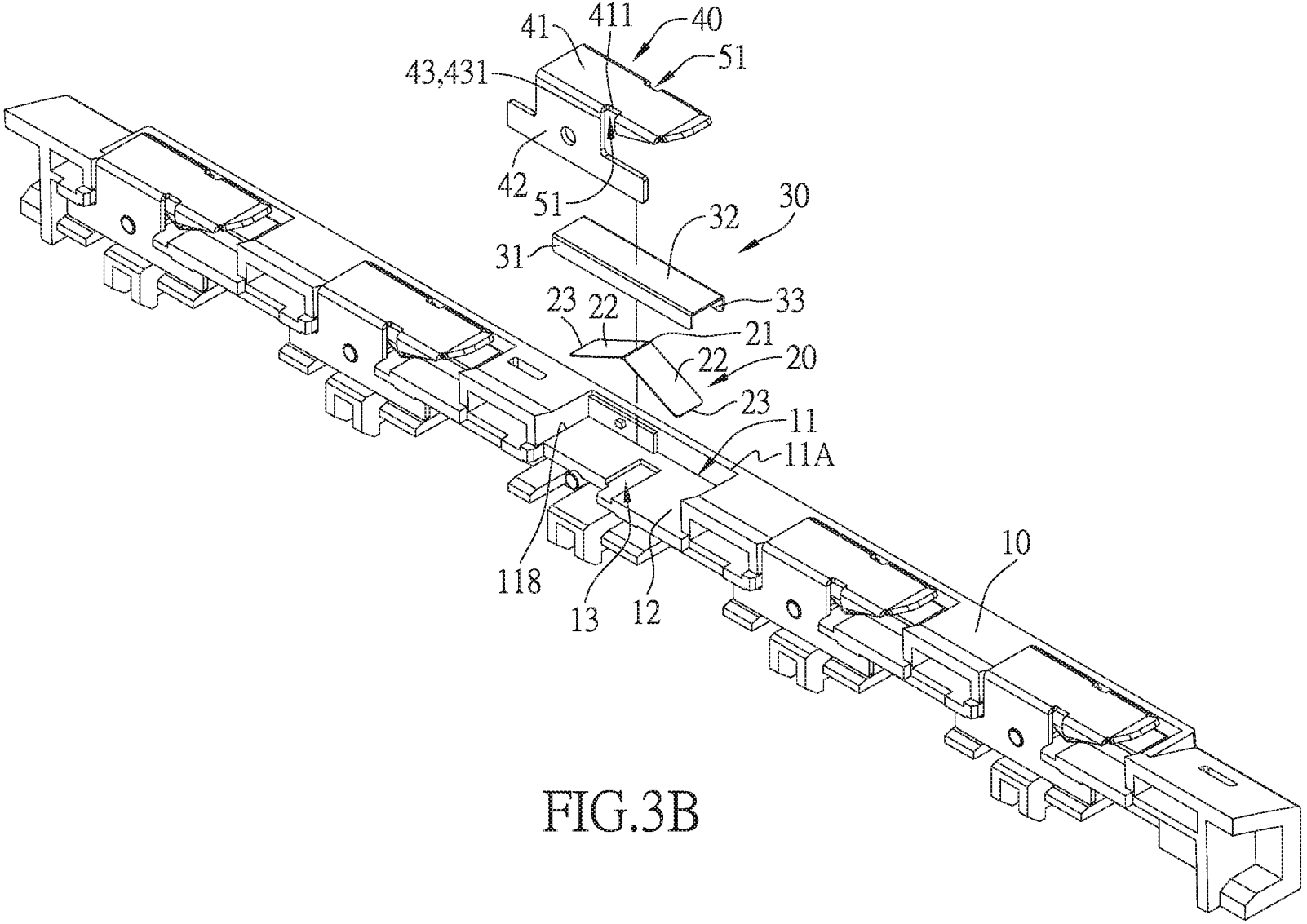
FIG. 3B is another exploded view of the first embodiment of the present invention.
Figure 4:
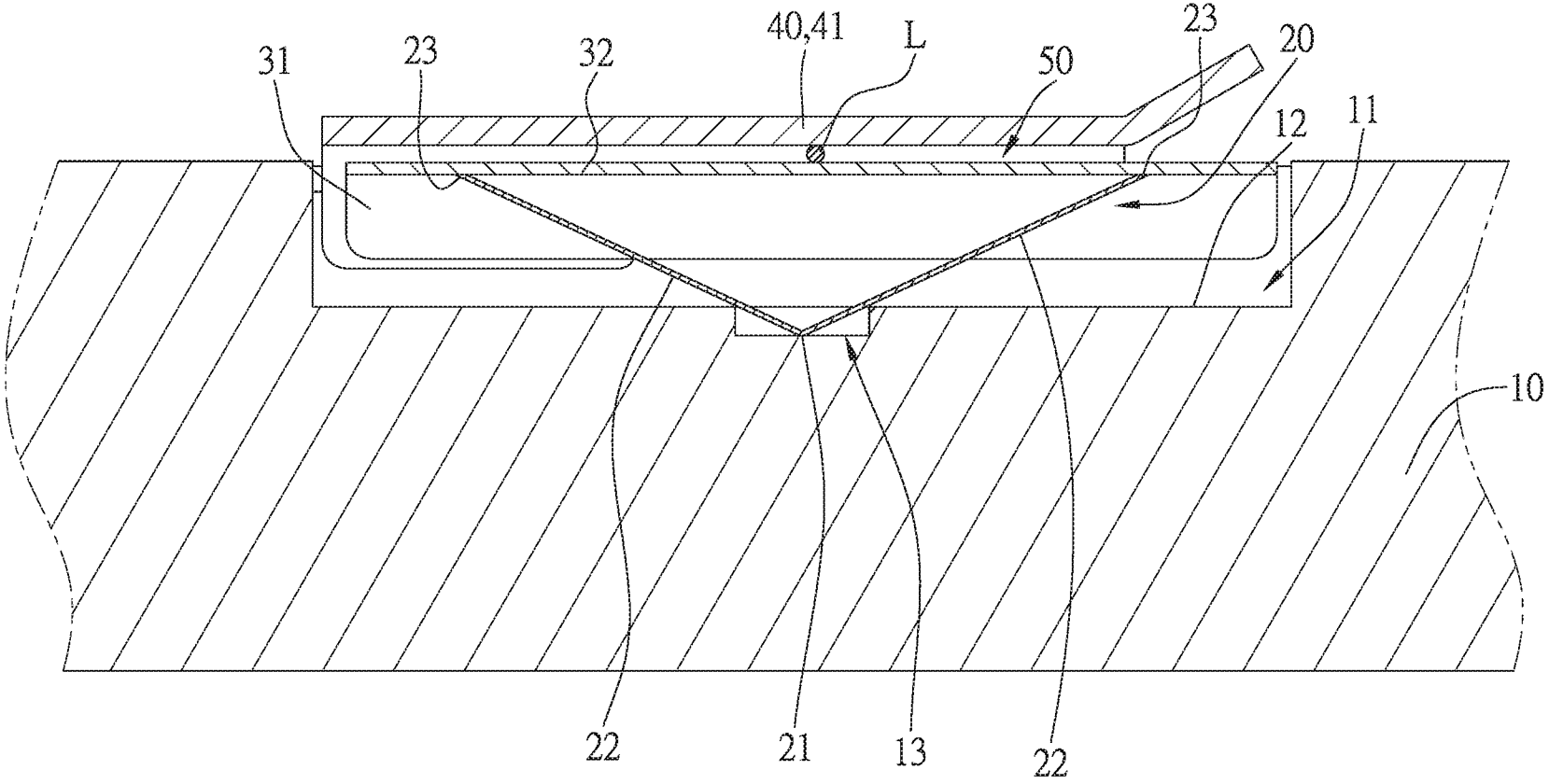
FIG. 4 is a cross-sectional view showing the first embodiment of the present invention.
Figure 5:
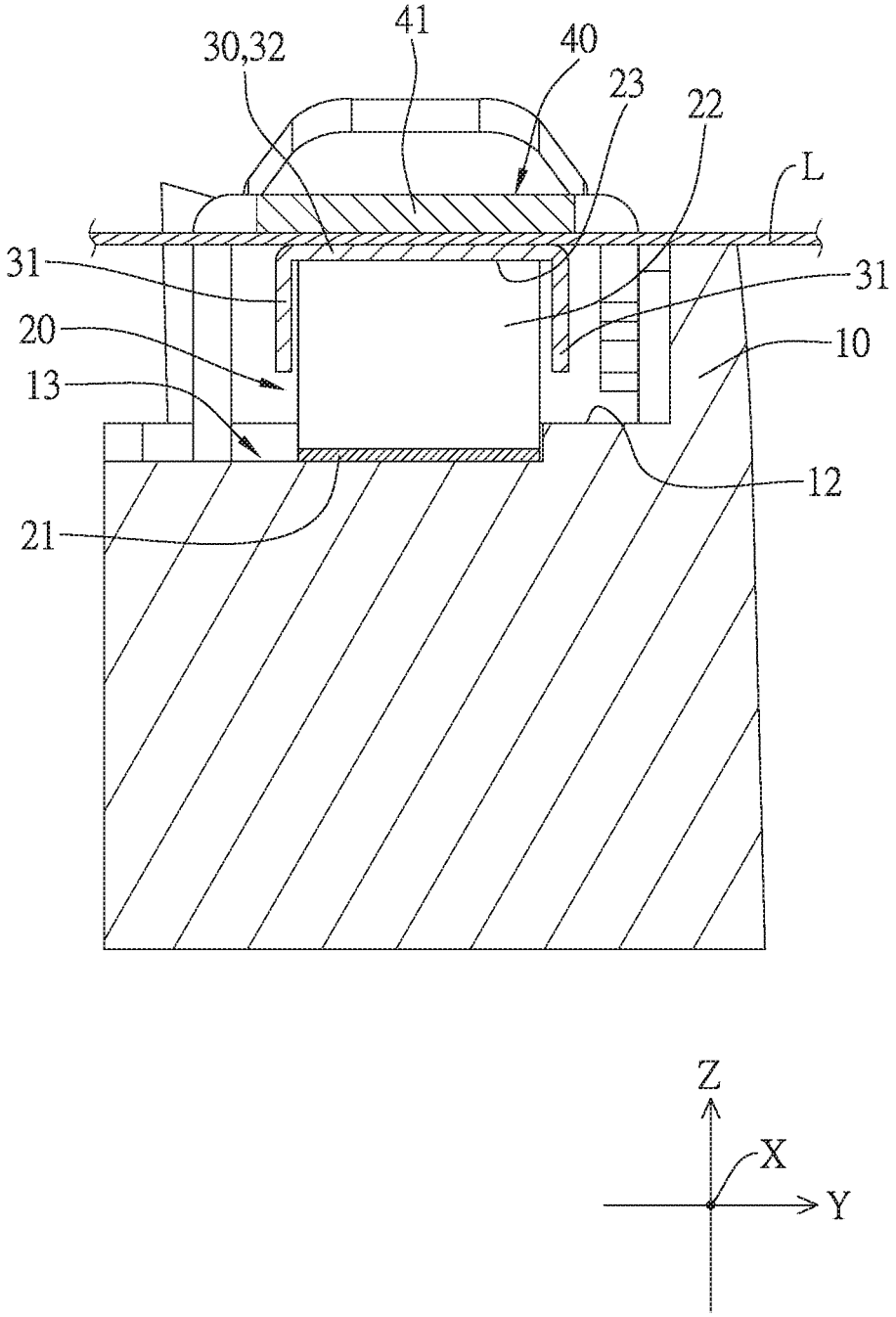
FIG. 5 is a cross-sectional view showing another angle of the first embodiment of the present invention.

In another embodiment, as shown in FIG. 3B, the difference of this embodiment from previous embodiment is that the abutting portions 23 are disposed on the groove bottom 12, and the folding portion 21 abuts against the abutting member 30.

In the first embodiment of the present invention, as shown in FIG. 3A, the pre-stress supply member 20 is a V-shaped elastic piece of a folded type, the folding portion 21 is located at a position where the elastic piece is folded, the two extension portions 22 are two sides of the elastic piece extending in different directions, and the two abutting portions 23 are two end edges of the elastic piece.

Figure 6:
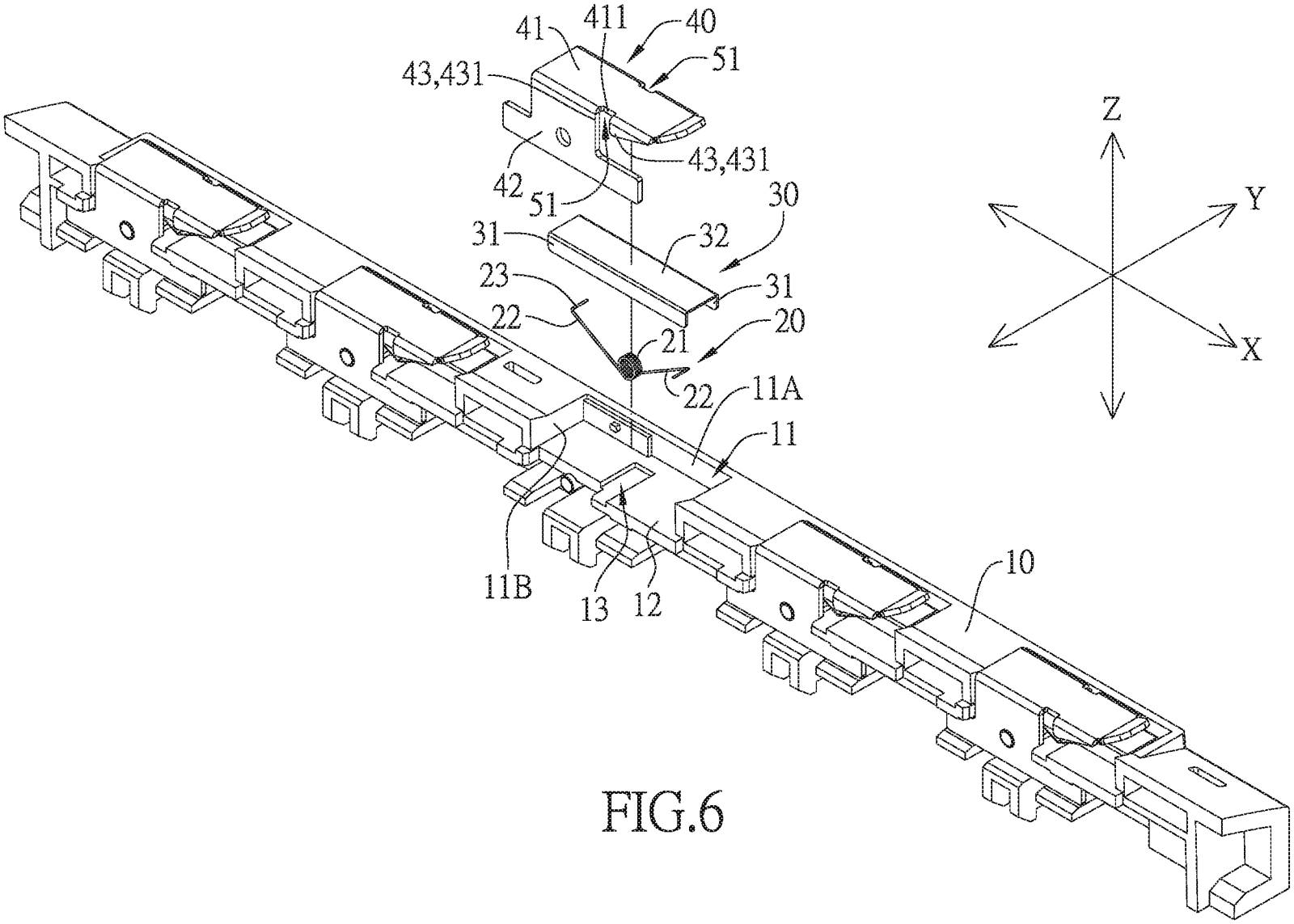
FIG. 6 is an exploded view of a second embodiment of the present invention.

In the second embodiment of the present invention, as shown FIG. 6, the pre-stress supply member 20 is a torsion spring which is generally V-shaped, the folding portion 21 is a coil portion of the torsion spring, the extension portions 22 are two arms extending from the coil portion, and the two abutting portions 23 are respectively connected to the folding ends of the arms.

Figure 7:
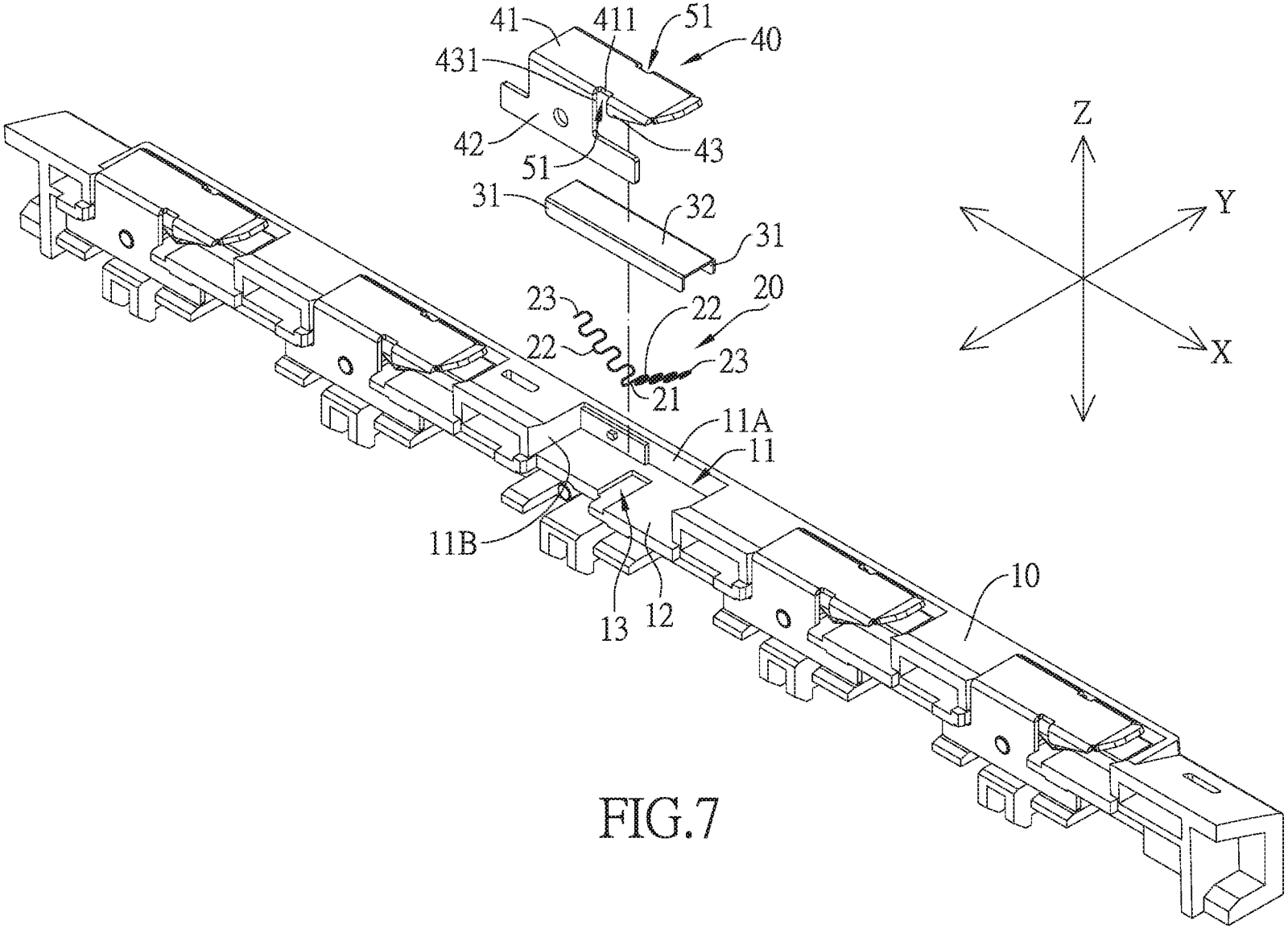
FIG. 7 is an exploded view of a third embodiment of the present invention.

In a third embodiment of the present invention, as shown in FIG. 7, the pre-stress supply member 20 is a bent iron wire, which is generally V-shaped, and the folding portion 21 is where the bent iron wire is folded.

Figure 8:
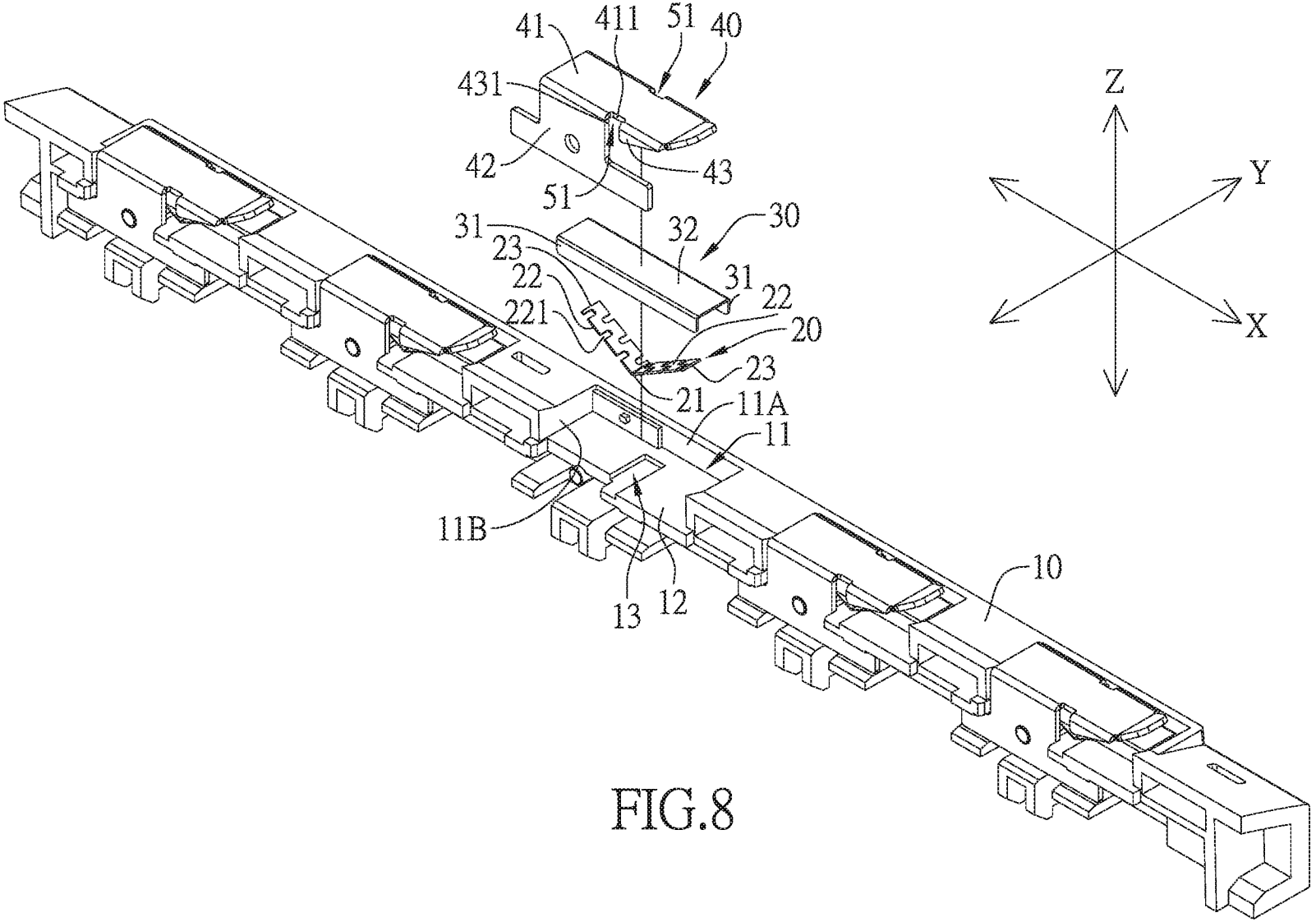
FIG. 8 is an exploded view of a fourth embodiment of the present invention.

In a fourth embodiment of the present invention, as shown in FIG. 8, the pre-stress supply member 20 is a V-shaped elastic piece of a folded structure, the folding portion 21 is located at a position where the elastic piece is folded, and the extension portions 22 are two sides of the elastic piece extending in different directions. The extension portions 22 are provided with a plurality of indentations 221 to reduce the weight of the pre-stress supply member 20 and control the elastic force of the pre-stress supply member 20, and the two abutting portions 23 are two end edges of the elastic piece, respectively.

Figure 9:
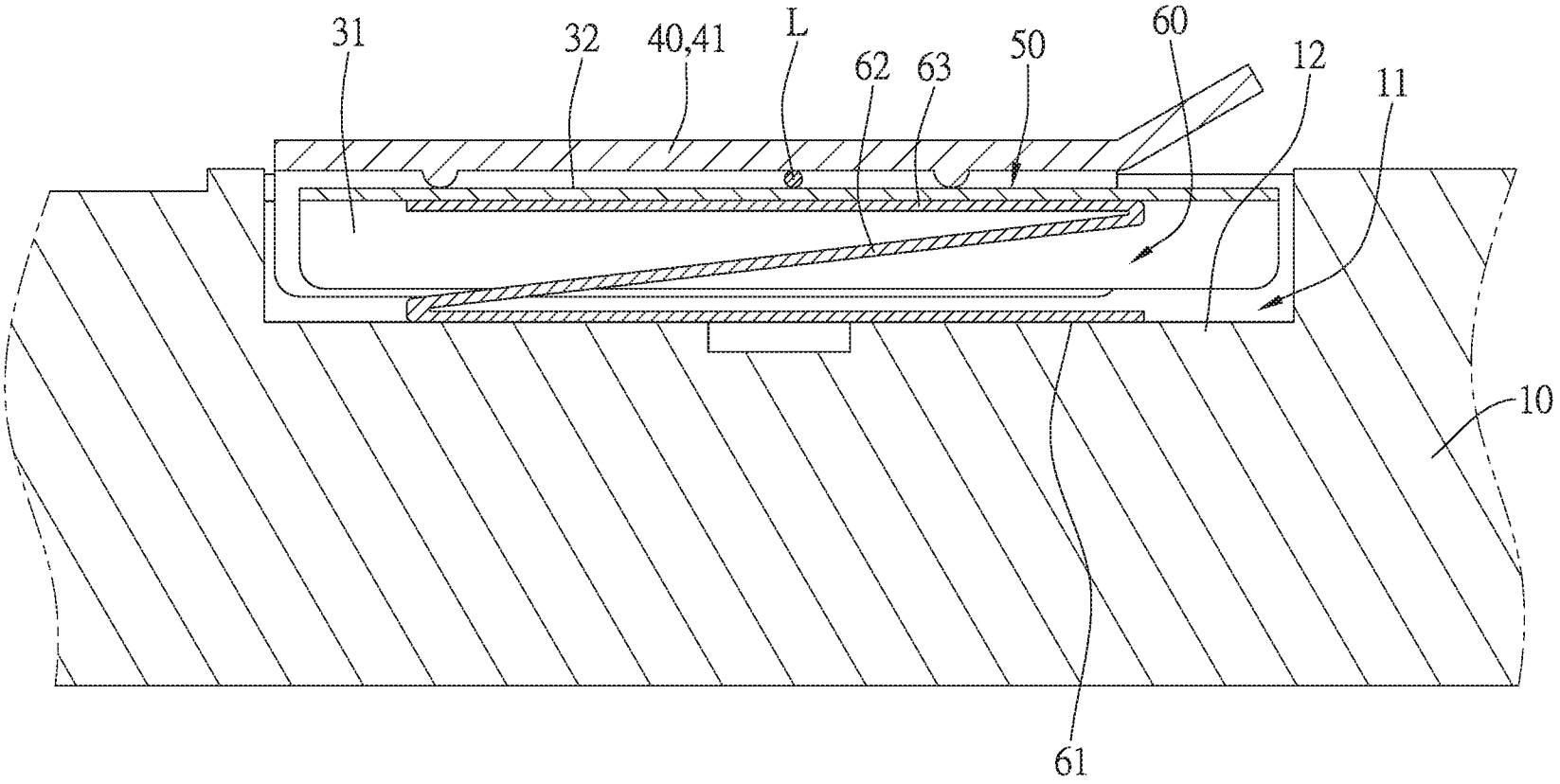
FIG. 9 is a cross-sectional view showing a fifth embodiment of the present invention.
Figure 10:
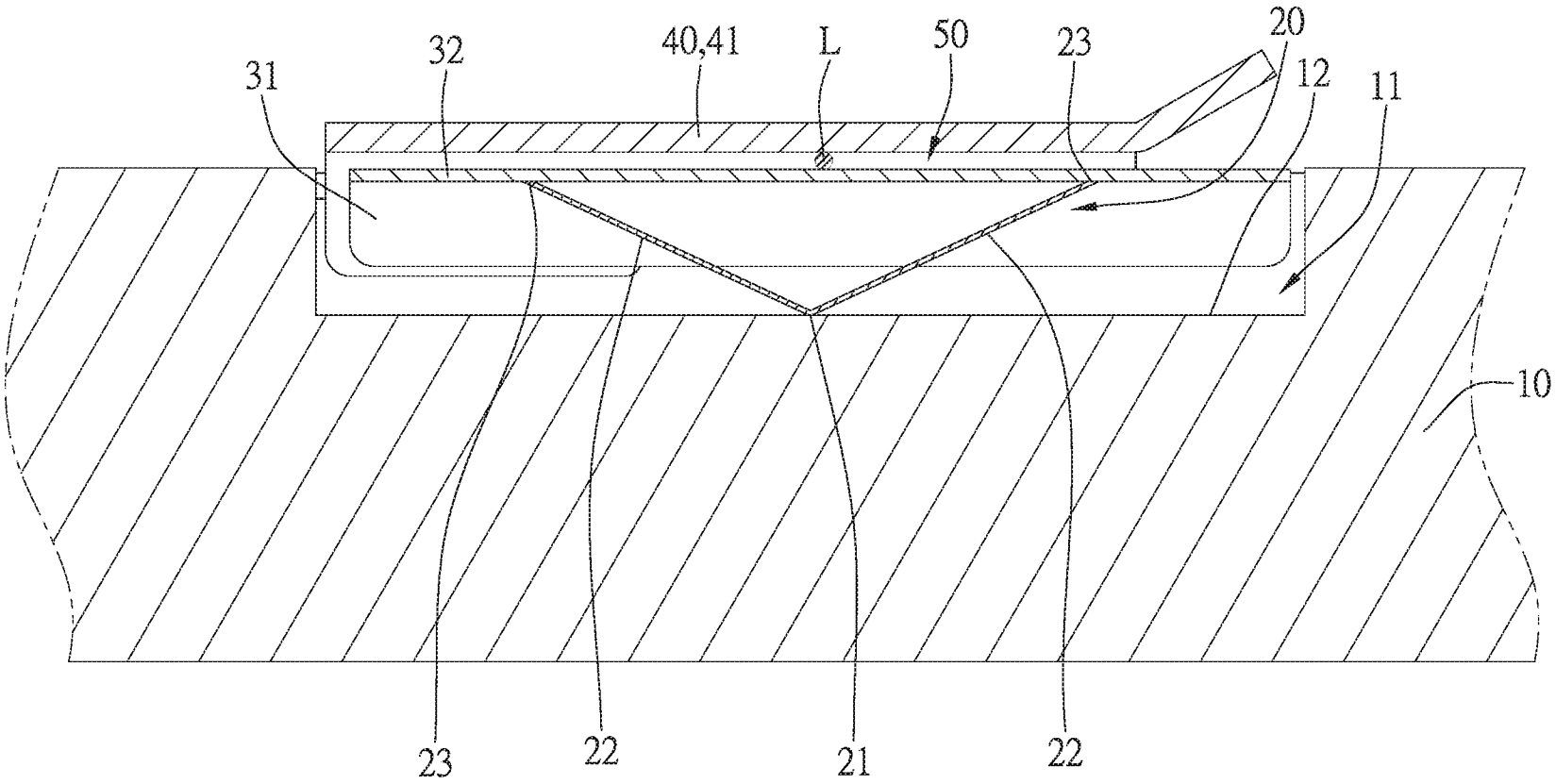
FIG. 10 is a cross-sectional view of a preferred embodiment of the present invention.
Figure 11:
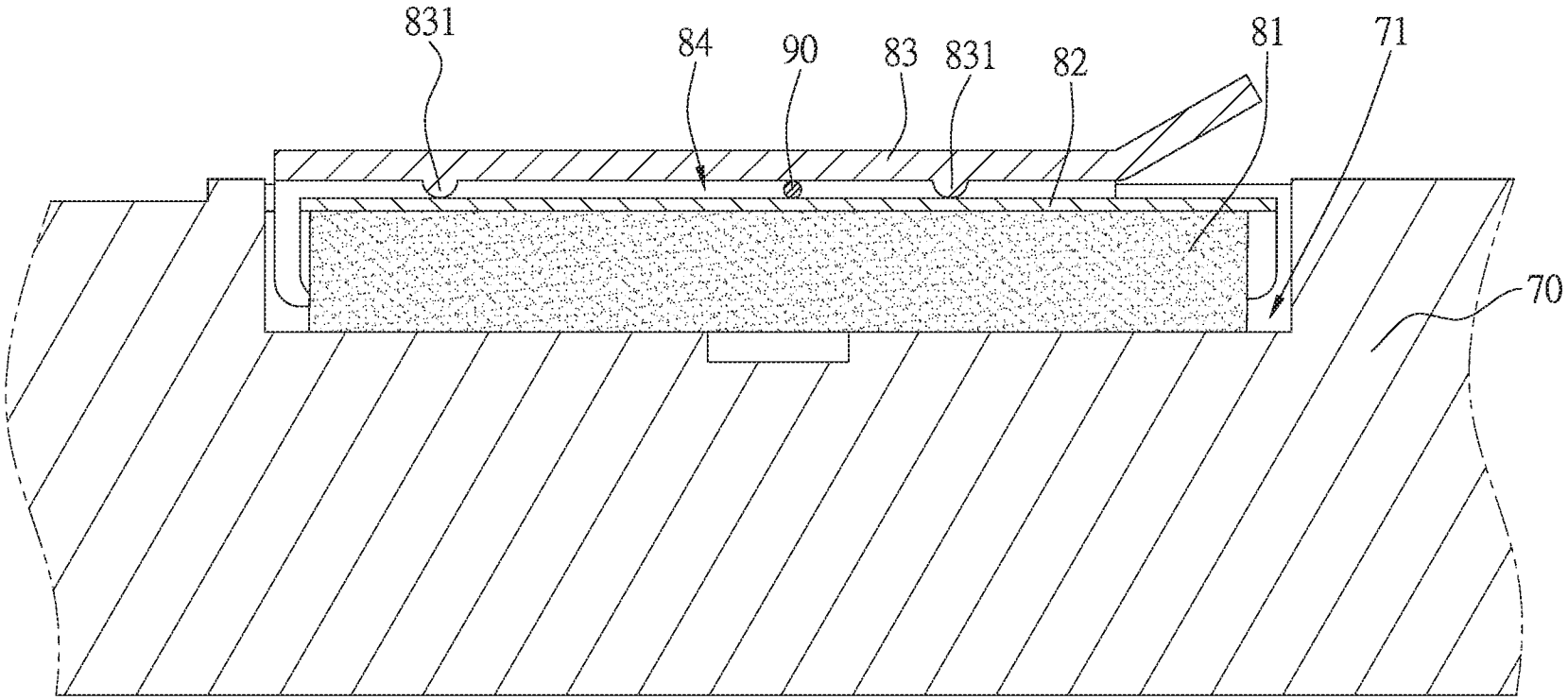
PRIOR ART FIG.11
FIG. 11 is a cross-sectional view of a conventional sewing-thread pre-stress device for a sewing machine.

In a fifth embodiment of the present invention, as shown in FIG. 9, another pre-stress supply member 60 is provided, which is made of an elastic material, that is, a material complying with Hooke's law. The pre-stress supply member 60 is disposed in the accommodating groove 11 and has a first pushing portion 61, a turning portion 62 and a second pushing portion 63 which are connected to one another. An extending direction of the first pushing portion 61 is parallel to that of the second pushing portion 63. The first pushing portion 61 and the turning portion 62 define an angle therebetween, and the second pushing portion 63 and the turning portion 62 define an angle therebetween, so that the first pushing portion 61, the turning portion 62 and the second pushing portion 63 form a Z-shape in cross section. The first pushing portion 61 is disposed on the groove bottom 12, and the second pushing portion 63 abuts against the top portion 32, so that a margin of compression and restoring is provided between the first pushing portion 61 and the turning portion 62, and between the second pushing portion 63 and the turning portion 62, thereby providing the sewing thread a pre-stress.

As can be seen from the foregoing, each embodiment of the sewing-thread pre-stress device for a sewing machine in accordance with the present invention mainly provides proper elasticity by the pre-stress supply member 20, since the pre-stress supply member 20 is made of an elastic material and generally V-shaped, the amount of change in the elastic force is relatively small, the sewing thread L of different diameters can be inserted into the thread space 50. When the thicker sewing thread L is inserted into the thread space 50, it does not provide excessive abutting force, so that the sewing thread pressure is moderate, avoiding the problem that the knitted fabric wrinkles if the sewing thread pressure is excessively large or the sewing thread gets knotted if the sewing thread pressure is too small.

Furthermore, in each embodiment of the sewing-thread pre-stress device for a sewing machine of the present invention, the extension portions 22 on both sides of the pre-stress supply member 20 are extended evenly, so that the elastic force is evenly distributed over two sides of the abutting member 30 along the longitudinal direction X, and with the abutting portions 23, the force can be evenly distributed at both sides of the abutting member 30 along the transverse direction Y, thereby effectively achieving the effect of averaging the supplied force.

While we have shown and described various embodiments in accordance with the present invention, it is clear to those skilled in the art that further embodiments may be made without departing from the scope of the present invention.

What is claimed is:

1. A sewing-thread pre-stress device for a sewing machine, comprising:

a sewing-thread support including at least one accommodating groove which has a groove bottom;

a pre-stress supply member made of an elastic material, provided in the accommodating groove, and having a folding portion disposed at the groove bottom, and two extension portions each having one end connected to two sides of the folding portion;

an abutting member disposed on the pre-stress supply member, and the two abutting portions abut against the abutting member; and a top cover disposed on the abutting member and fixed to the sewing-thread support, so that a thread space is defined between the top cover and the abutting member for allowing a sewing thread to be inserted therethrough.

2. The sewing-thread pre-stress device for the sewing machine as claimed in claim 1, wherein a limiting groove is formed at the groove bottom of the accommodating groove, and the folding portion is disposed in the limiting groove.

3. The sewing-thread pre-stress device for the sewing machine as claimed in claim 2, wherein the sewing-thread support defines a plurality of said accommodating grooves along a longitudinal direction, each of the accommodating grooves is a rectangular groove and has a first side along the longitudinal direction, a direction perpendicular to the longitudinal direction is defined as a transverse direction, and each of the accommodating grooves has a second side along the transverse direction.

4. The sewing-thread pre-stress device for the sewing machine as claimed in claim 1, wherein the top cover has a cover portion and a locking portion, the locking portion is fixed to the sewing-thread support, and the cover portion is located on another surface of the abutting member opposite to one surface thereof facing the pre-stress supply member.

5. The sewing-thread pre-stress device for the sewing machine as claimed in claim 1, wherein the abutting portion extends in a direction perpendicular to an extending direction of the extension portions.

6. The sewing-thread pre-stress device for the sewing machine as claimed in claim 1, wherein the abutting member is a rectangular sheet member.

7. The sewing-thread pre-stress device for the sewing machine as claimed in claim 1, wherein the abutting member has a first lateral portion, a top portion and a second lateral portion which are connected to one another, the top portion has two opposite edges connected to the first and second lateral portions, respectively, the first and second lateral portions are connected to the top portion at an angle, so that the abutting member is U-shaped at cross section, and the two abutting portions are abutted against the top portion.

8. The sewing-thread pre-stress device for the sewing machine as claimed in claim 1, wherein the top cover has a limiting portion formed on each of two lateral surfaces of the cover portion, each of the limiting portions has two limiting bodies, a thread hole is formed between the two limiting bodies and communicates with the thread space.

9. The sewing-thread pre-stress device for the sewing machine as claimed in claim 8, wherein the limiting portions are formed on each of the two lateral surfaces of the cover portion adjacent to one end of the cover portion, the sewing-thread support, the pre-stress supply member, the abutting member and the top cover are stacked along a height direction, and the two limiting bodies extend along the height direction.

10. The sewing-thread pre-stress device for the sewing machine as claimed in claim 3, wherein the sewing-thread support, the pre-stress supply member, the abutting member and the top cover are stacked along the height direction which is perpendicular to the transverse direction and the longitudinal direction, the top cover is fixed, the abutting member is movable along the height direction to control a width of the thread space.

11. The sewing-thread pre-stress device for the sewing machine as claimed in claim 1, wherein the pre-stress supply member includes three types, a first one of the three types is a V-shaped elastic piece of a folded structure, the folding portion is located at a position where the elastic piece is folded, the extension portions are two sides of the elastic piece extending in different directions, the two abutting portions are two end edges of the elastic piece, respectively, a second one of the three types is a torsion spring which is V-shaped, the folding portion is a coil portion of the torsion spring, the extension portions are two arms extending from the spring coil, the two abutting portions are respectively connected to folding ends of the arms.

12. The sewing-thread pre-stress device for the sewing machine as claimed in claim 1, wherein the sewing-thread support is integral with the sewing machine.

13. A sewing-thread pre-stress device for a sewing machine, comprising:

a sewing-thread support including at least one accommodating groove which has a groove bottom;

a pre-stress supply member made of an elastic material, provided in the accommodating groove, and having a folding portion disposed at the groove bottom, and two extension portions each having one end connected to two sides of the folding portion;

an abutting member disposed on the pre-stress supply member, and the folding portion abuts against the abutting member; and a top cover disposed on the abutting member and fixed to the sewing-thread support, so that a thread space is defined between the top cover and the abutting member for allowing a sewing thread to be inserted therethrough.

14. A sewing-thread pre-stress device for a sewing machine, comprising:

a sewing-thread support including at least one accommodating groove which has a groove bottom;

a pre-stress supply member made of an elastic material, provided in the accommodating groove, and having a first pushing portion, a turning portion and a second pushing portion which are connected to one another, the first pushing portion and the turning portion define an angle therebetween, the second pushing portion and the turning portion define an angle therebetween, the first pushing portion is disposed on the groove bottom;

an abutting member disposed on the pre-stress supply member, and the second pushing portion abuts against the abutting member; and a top cover disposed on the abutting member and fixed to the sewing-thread support, so that a thread space is defined between the top cover and the abutting member for allowing a sewing thread to be inserted therethrough.

* * * * *